United States Patent [19]

Frohbieter

[11] 4,439,996

[45] Apr. 3, 1984

[54] BINARY REFRIGERANT SYSTEM WITH EXPANSION VALVE CONTROL

[75] Inventor: Edwin H. Frohbieter, Lincoln Township, Berrien County, Mich.

[73] Assignee: Whirlpool Corporation, Benton Harbor, Mich.

[21] Appl. No.: 338,580

[22] Filed: Jan. 8, 1982

[51] Int. Cl.[3] ..... F25B 41/00

[52] U.S. Cl. ..... 62/174; 62/196.1; 62/197; 62/502; 62/503; 62/513

[58] Field of Search ..... 62/114, 502, 149, 174, 62/511, 197, 196 R, 113, 513, 205, 198, 216, 186, 503, 526

[56] References Cited

U.S. PATENT DOCUMENTS

| | | | |
|---|---|---|---|
| 2,255,584 | 9/1941 | Hubacker | 62/76 |
| 2,260,825 | 10/1941 | Blood | 62/445 |
| 2,277,138 | 3/1942 | Newton | 62/93 |
| 2,405,392 | 8/1946 | Atchison | 62/334 |
| 2,483,842 | 10/1949 | Philipp | 62/444 |
| 2,667,757 | 2/1954 | Shoemaker | 62/526 X |
| 2,682,756 | 7/1954 | Clark et al. | 62/335 |
| 2,739,450 | 3/1956 | Breck | 62/196 R X |
| 2,769,312 | 11/1956 | Harrold et al. | 62/216 |
| 2,794,322 | 6/1957 | Etherington | 62/114 |
| 2,794,328 | 6/1957 | Herrick | 62/114 |
| 2,794,329 | 6/1957 | Herrick | 62/114 |
| 2,799,142 | 7/1957 | Schubert et al. | 62/114 |
| 2,841,965 | 7/1958 | Etherington | 62/513 |
| 2,867,094 | 1/1959 | Herrick | 62/174 |
| 2,867,099 | 1/1959 | Schubert | 62/502 |
| 3,019,614 | 2/1962 | Schubert et al. | 62/114 |
| 3,359,751 | 12/1967 | Stevens | 62/186 |
| 4,179,898 | 12/1979 | Vakil | 62/114 |
| 4,217,760 | 8/1980 | Vakil et al. | 62/114 |
| 4,218,890 | 8/1980 | Vakil et al. | 62/114 |

OTHER PUBLICATIONS

Lorenz et al., *On Application of Non-Azeotropic Two--Component Refrigerants in Domestic Refrigerators and Home Freezers,* XIV International Refrigeration Congress, Moscow 1975.

*Primary Examiner*—Henry C. Yuen
*Assistant Examiner*—Harry Tanner
*Attorney, Agent, or Firm*—Wood, Dalton, Phillips, Mason & Rowe

[57] ABSTRACT

A refrigerant apparatus having an accumulator for receiving binary refrigerant from the evaporator of the apparatus. An expansion valve is connected in parallel with a capillary duct for increasing the refrigerant delivery from a preselected minimum determined by the capillary tube to controlledly flood the evaporator. The lower boiling point component of the binary refrigerant is caused to be separated in the accumulator for delivery to the compressor during flooded operation of the apparatus so as to increase the proportion of the low boiling point component in the binary refrigerant to provide increased refrigeration capacity to meet the increased demand. Upon decrease in the demand, the accumulated liquid refrigerant in the accumulator is gasified for returning the system to the normal ratio of components of the binary refrigerant. The expansion valve is caused to operate as a function of the temperature of the space refrigerated by the evaporator in effecting the desired flooding operation.

11 Claims, 2 Drawing Figures

BINARY REFRIGERANT SYSTEM WITH EXPANSION VALVE CONTROL

BACKGROUND OF THE INVENTION

1. Field of the Invention

This invention relates to refrigeration apparatus and in particular to refrigeration apparatus utilizing a binary refrigerant.

2. Description of the Background Art

In a paper presented before the International Refrigeration Congress in Moscow, Russia, in 1975, A. Lorenz and K. Meutzner describe a non-azeotropic two-component refrigerant domestic refrigerator-home freezer system. As shown in FIG. 4 of the publication, it was known, in 1975, to provide a refrigeration apparatus having a first evaporator in the freezer zone and a second evaporator in the above-freezing zone of a refrigerator, with a first heat exchanger between the condenser and the freezer evaporator, and a second heat exchanger between the freezer evaporator and the above-freezing compartment evaporator. The refrigerant comprised a binary refrigerant of R 22/R11 composition.

Another binary refrigerant system is illustrated in U.S. Letters Pat. No. 2,799,142 of Albert E. Schubert et al for providing dual temperature levels of refrigeration in the system. The refrigerant components in the Schubert et al patent comprise Freon 22 and Freon 12. The system is arranged for selectively circulating one of the refrigerants, substantially purging the system of that refrigerant, and circulating the other refrigerant through the system, while purifying the first refrigerant during the circulation of the other refrigerant. The means for purifying the refrigerant comprises distilling means.

SUMMARY OF THE INVENTION

The present invention comprehends an improved refrigeration apparatus and system wherein means are provided for controlledly flooding an evaporator means in response to an increased heat load. The system employs a binary refrigerant for storing liquid and gaseous phases of the refrigerant connected between the evaporator means and the compressor. During flooding, the gaseous phase of the refrigerant in the accumulator will be richer in the lower boiling point component of the binary refrigerant. Continued operation of the compressor draws the low boiling point enriched gaseous refrigerant from the accumulator so as to circulate the enriched refrigerant while temporarily storing the higher boiling point component in the liquid phase within the accumulator.

When the heat demand is increased, the liquid phase of the refrigerant in the accumulator gasifies so as to return the binary refrigerant to the original ratio. The refrigerant leaving the evaporator means, in normal operation of the system, is superheated so as to maintain the normal ratio of the binary refrigerant being circulated by the compressor.

In maximum capacity operation, only the lower boiling point refrigerant component is being circulated as the accumulator may be sized to store all of the higher boiling point component in liquid form therein.

The system may further include means for shifting the cooling effect from the freezer zone to the fresh food zone.

Thus, the refrigeration apparatus and system of the present invention is extremely simple and economical of construction while yet providing the highly desirable improved functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
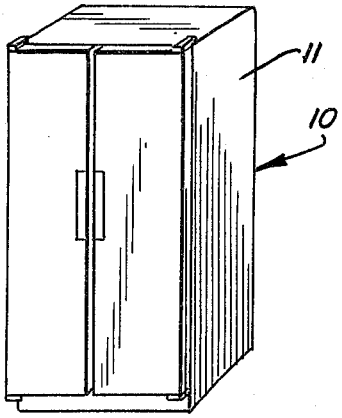
FIG. 1 is a perspective view of a refrigeration apparatus having a refrigerant flow circuit embodying the invention.
Figure 2:
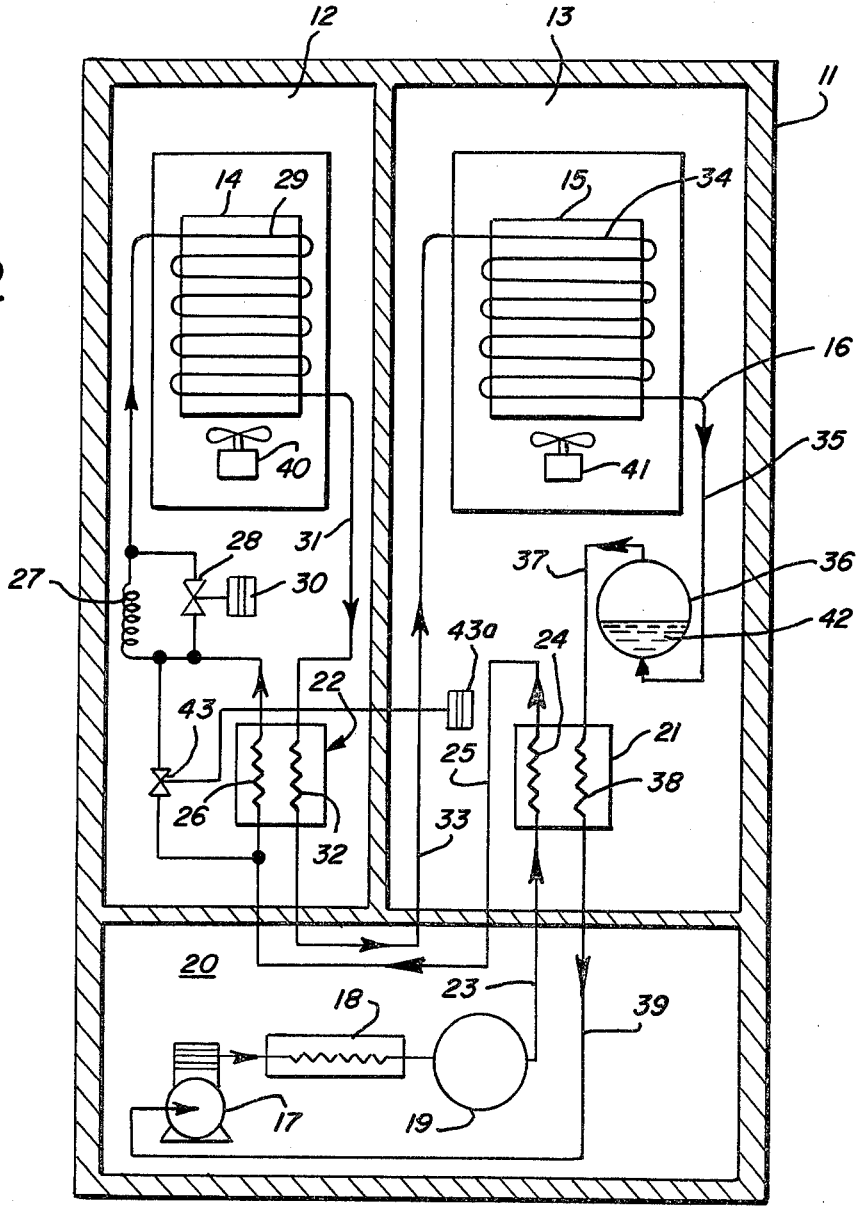
FIG. 2 is a schematic vertical section illustrating the arrangement of the refrigerant system.

In the exemplary embodiment of the invention as disclosed in the drawing, a refrigeration apparatus generally designated 10 is shown to comprise a side-by-side freezer-refrigerator having a cabinet 11 defining a freezer compartment, or zone, 12, and a fresh food, above-freezing compartment, or zone, 13. At first, freezer evaporator 14 is provided in the freezer zone 12 and a second, fresh food evaporator 15 is provided in the fresh food zone 13. The refrigerant flow circuit generally designated 16 includes a compressor 17, a condenser 18, and a first accumulator 19 disposed within a machinery space 20. A first heat exchanger 21 is provided in the fresh food zone 13, and a second heat exchanger 22 is provided in the freezer zone 12. The disclosed apparatus and system employs a binary refrigerant having substantially 50% of each component, and which is conducted through a transfer conduit 23 to the inlet conduit 24 of heat exchanger 21, and from inlet conduit 24 through a transfer conduit 25 to the inlet conduit 26 of heat exchanger 22.

From heat exchanger conduit 26, the refrigerant is conducted through a capillary tube 27 and an expansion valve 28 to the coil 29 of the evaporator 14. Expansion valve 28 is controlled by an actuator 30 responsive to the temperature of the air in freezer zone 12 so as to provide increased refrigerant flow to the evaporator as a function of the sensed temperature. Capillary tube 27 provides a minimum flow to the evaporator coil 29 at all times so as to permit the apparatus to function continuously, i.e. in a noncyclical manner.

The refrigerant fluid is conducted from evaporator coil 29 through a transfer conduit 31 to the outlet conduit 32 of heat exchanger 22 and from conduit 32 through a transfer conduit 33 to the coil 34 of evaporator 15.

From evaporator coil 34, the refrigerant fluid is conducted through a transfer conduit 35 to a second accumulator 36. From accumulator 36, the gaseous refrigerant is delivered through a transfer conduit 37 through the outlet conduit 38 of the heat exchanger 21 and a transfer conduit 39 to the compressor 17.

A first motor driven fan 40 is provided in freezer zone 12 for flowing air in heat exchange relationship with the evaporator 14 and a second motor-driven fan 41 is provided in fresh food zone 13 for flowing air in heat transfer relationship with evaporator 15.

Accumulator 36 defines means for storing liquid refrigerant delivered from the evaporator coil 34 when the evaporator means are flooded as by opening of the expansion valve 28. As indicated above, in the normal operation of the refrigeration system, the refrigerant provided through capillary 27 maintains a low rate of cooling so as to cause continuous operation of the system. In the event that the temperature sensed by actuator 30 rises above a preselected temperature, expansion valve 28 is caused to open, thereby increasing the delivery of liquid refrigerant to the evaporator coil 29 and effectively causing flooding thereof.

As a result of the flooded condition of the evaporators, a portion of the binary refrigerant delivered to accumulator 36 is in the form of liquid. As the compressor 17 provides a suction pressure on the space in accumulator 36 above the temporarily stored liquid refrigerant 42, and the gaseous phase and liquid phase have essentially the same temperature and pressure, the gaseous phase is richer in the lower boiling point component of the binary refrigerant. In the illustrated embodiment, the binary refrigerant is a nonazeotropic mixture comprising an equal amount of F114 and F12 refrigerants. Thus, the F12 component will be richer in the gaseous phase than in the liquid phase. As a result, the compressor draws off a refrigerant gas which is richer in F12 than in F114 component. Resultingly, the condensate delivered from condenser 18 to accumulator 19 is enriched in the F12 component. During the flooded operation, the vapor leaving accumulator 19 is richer in the F12 component, so that, eventually, a condition may be reached wherein only the lower boiling point F12 component is circulating. Thus, effectively, the system is operating with the F12 component as the sole active refrigerant, with the F114 being stored in the accumulator 36 as a pool of liquid. This would represent the maximum capacity condition of the system.

At any time during the flooding operation should the temperature sensed by the actuator 30 drop sufficient to close the expansion valve 28, the system will be returned to the non-flooding operating condition wherein the only flow to the evaporators is that permitted by the capillary 27.

Thus, the system operates automatically to provide a change in the capacity of the system by varying the ratio of the binary refrigerant components as a function of the temperature of the air in the freezer zone.

At times, it may be desired to transfer the refrigerating effect to some extent from the freezer zone to the fresh food zone as where a heat load is placed on the evaporator 15. To effect such a transfer, a bypass valve 43 is connected across the inlet conduit 26 of heat exchanger 22 so as to provide a refrigerant flow path around heat exchanger inlet conduit 26. The valve 43 is controlled by an actuator **43*a* responsive to the air temperature of fresh food zone 13. By substantially reducing flow of hot refrigerant through the conduit 26, the refrigerant leaving evaporator coil 29 and flowing through heat exchanger conduit 32 is not warmed, but rather, is delivered to the fresh food evaporator coil 34** at minimum temperature.

By utilizing the separate evaporators, each of the storage compartments may be refrigerated independently. Thus, the refrigeration of the fresh food space 13 may be effected by operating the evaporator 15 at a temperature only slightly colder than the desired compartment temperature. Further, it is desirable to effectively maximize the energy usage efficiency in the operation of the refrigeration apparatus. It has been found that a refrigerator/freezer system that operates continuously is advantageous in such energy usage efficiency improvement by eliminating losses resulting from cycling of the apparatus. The present invention provides such continuous non-cycling operation while yet effectively minimizing the cooling of the zones to the desired temperature, while yet permitting automatic increase in the cooling capacity when necessary automatically by the control effected by the temperature responsive expansion valve and liquid storage accumulator means. The actuation of the expansion valve may be preselected so as to accurately follow the load requirements in providing the controlled flooding of the evaporators in effecting the desired change in the ratio of the binary refrigerant components.

Resultingly, the system operates close to the maximum coefficient of performance during a majority of the time, thereby providing substantially improved energy usage efficiency.

The foregoing disclosure of specific embodiments is illustrative of the broad inventive concepts comprehended by the invention.

I claim:

1. In a variable capacity refrigerator-freezer including means forming a fresh food storage compartment, means forming a frozen food storage compartment, and a sealed refrigeration system including a fresh food evaporator, a freezer evaporator, a compressor, a condenser, refrigerant expansion means for modulating the capacity of said refrigeration system, a series of refrigerant conduits connecting said evaporators, compressor, expansion means, and condenser into a sealed system, and within said sealed system a refrigerant mixture of two nonazeotropic refrigerants having substantially different boiling points, the improvement comprising:

a first accumulator connected between said condenser and said expansion means to receive the condensate leaving the condenser;

a second refrigerant accumulator connected between said fresh food evaporator and said compressor, said refrigerant expansion means for modulating the capacity of said refrigeration system comprising an air sensing thermostatically controlled expansion valve in said frozen food storage compartment for controlling flow of refrigerant to said freezer evaporator, and a capillary tube connected to said conduits so as to bypass said expansion valve, said capillary tube being sized to provide at least a minimum capacity flow for said system at all times, said capillary tube comprising means for metering the flow of refrigerant so that only superheated refrigerant vapors leave said fresh food evaporator and said second accumulator tends to become free of liquid refrigerant as a result of said expansion valve closing, whereby said system is operating at its lowest capacity since all of the higher boiling point refrigerant in the system is in the active refrigerant stream, whereby the refrigeration system comprises automatically a modulated binary refrigerant system, said condensate leaving the condenser having the same refrigerant composition as the gas from said second accumulator, and as the freezer evaporator continues to flood more of the total refrigerant in said sealed system leaves said first accumulator and is stored in said second accumulator until substantially only the lower boiling point refrigerant is circulating in said sealed system with a pool of the higher boiling point refrigerant accumulating in said second accumulator, and with the lower boiling point refrigerant at saturation supplying the compressor whereby said system is operating at maximum capacity;

a heat exchanger interposed between said first accumulator and said expansion means; and means to shift refrigeration effect from the freezer compartment to the fresh food compartment comprising a bypass conduit around a heat-giving portion of said heat exchanger, said conduit having a valve controlled by air temperature in said fresh food storage compartment to shunt refrigerant around said heat exchanger, thereby causing the refrigerant leaving the heat exchanger to become colder before its entry to the fresh food compartment evaporator.

2. The variable capacity refrigerator-freezer of claim 1 wherein said capillary tube comprises means for providing a minimum refrigerant flow passage to said evaporators atall times.

3. The variable capacity refrigerator-freezer of claim 1 wherein said thermostatically controlled expansion valve comprises responsive to the temperature of the freezer zone.

4. The variable capacity refrigerator-freezer of claim 1 wherein said thermostatically controlled expansion valve comprises means responsive to the air temperature in the freezer zone.

5. The variable capacity refrigerator-freezer of claim 1 further including means for decreasing the cooling effect in said freezer zone and concurrently increasing the cooling effect in said fresh food zone.

6. The variable capacity refrigerator-freezer of claim 1 further including means for superheating the refrigerant being delivered from the second accumulator to the compressor.

7. The variable capacity refrigerator-freezer of claim 1 wherein as the refrigeration load increases in either of said fresh food or said frozen food storage compartments, said expansion valve will start to open in response to sensing of a predetermined air temperature within said frozen food storage compartment, thereby increasing the flow of refrigerant mixture to said freezer evaporator causing flooding thereof and causing collection in said accumulator of some of the refrigerant mixture in liquid and gaseous form, the gas and liquid in said accumulator being at essentially the same temperature and pressure, and the gas over the liquid in said accumulator being richer in the lower boiling point portion of the refrigerant mixture than the liquid in said accumulator.

8. The variable capacity refrigerator-freezer system of claim 1 wherein said refrigerant mixture comprises approximately 50% of each refrigerant.

9. The variable capacity refrigerator-freezer of claim 1 wherein said refrigerant mixture comprises approximately 50% of each refrigerant, and the system capacity can be increased approximately 50% by increasing the higher boiling point refrigerant in storage in said second accumulator from none to a maximum quantity for the system.

10. The variable capacity refrigerator-freezer of claim 1 further including motor-driven fans for forcing air to pass in heat transfer association with each of said evaporators.

11. The variable capacity refrigerator-freezer of claim 1 wherein the refrigerant delivered to said second refrigerant accumulator from the evaporator means is superheated under normal heat load conditions of the apparatus.

* * * * *

UNITED STATES PATENT AND TRADEMARK OFFICE

CERTIFICATE OF CORRECTION

PATENT NO. : 4,439,996

DATED : April 3, 1984

INVENTOR(S) : Edwin H. Frohbieter

It is certified that error appears in the above-identified patent and that said Letters Patent is hereby corrected as shown below:

Claim 3, line 3 (col. 5, line 19), after "comprises" insert --means--.

Signed and Sealed this

*Third* Day of *December 1985*

[SEAL]

*Attest:*

DONALD J. QUIGG

*Attesting Officer*

*Commissioner of Patents and Trademarks*